US009319800B2

(12) United States Patent
Hong et al.

(10) Patent No.: US 9,319,800 B2
(45) Date of Patent: Apr. 19, 2016

(54) ELECTRO ACOUSTIC TRANSDUCER

(71) Applicant: SAMSUNG ELECTRONICS CO., LTD., Suwon-si (KR)

(72) Inventors: Seog-woo Hong, Yongin-si (KR); Hyung-jae Shin, Seongnam-si (KR); Dong-sik Shim, Hwaseong-si (KR); Byung-gil Jeong, Anyang-si (KR); Seok-whan Chung, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/317,135

(22) Filed: Jun. 27, 2014

(65) Prior Publication Data

US 2015/0230029 A1 Aug. 13, 2015

(30) Foreign Application Priority Data

Feb. 12, 2014 (KR) ..... 10-2014-0016281

(51) Int. Cl.

| | |
|---|---|
| ***H04R 23/00*** | (2006.01) |
| ***B06B 1/02*** | (2006.01) |
| ***B06B 1/06*** | (2006.01) |
| ***G10K 11/00*** | (2006.01) |

(52) U.S. Cl.

CPC ..... *H04R 23/00* (2013.01); *B06B 1/0292* (2013.01); *B06B 1/0685* (2013.01); *G10K 11/002* (2013.01); *H04R 2201/003* (2013.01)

(58) Field of Classification Search

CPC ..... B06B 1/02

USPC ..... 156/252; 228/101; 257/E21.002; 367/140

See application file for complete search history.

(56) References Cited

U.S. PATENT DOCUMENTS

| | | | | |
|---|---|---|---|---|
| 2007/0153632 | A1 | 7/2007 | Chang et al. | |
| 2010/0013574 | A1* | 1/2010 | Huang | 333/186 |
| 2012/0091543 | A1* | 4/2012 | Torashima et al. | 257/415 |
| 2013/0051179 | A1* | 2/2013 | Hong | 367/140 |
| 2013/0169110 | A1 | 7/2013 | Jeong et al. | |

FOREIGN PATENT DOCUMENTS

| | | | |
|---|---|---|---|
| KR | 10-2011-0025447 | A | 3/2011 |
| KR | 10-2013-0021657 | A | 3/2013 |
| KR | 10-2013-0022408 | A | 3/2013 |
| WO | 2012/127360 | A2 | 9/2012 |

OTHER PUBLICATIONS

Communication from the European Patent Office issued Nov. 17, 2015 in a counterpart European Application No. 14178357.1.

* cited by examiner

*Primary Examiner* — David Vu
*Assistant Examiner* — Jonathan Han
(74) *Attorney, Agent, or Firm* — Sughrue Mion, PLLC

(57) ABSTRACT

An electro-acoustic transducer includes a conductive substrate provided with at least one cell and at least one electrode, and a pad substrate disposed corresponding to the conductive substrate and provided with at least one pad corresponding to the electrode, in which at least one of the electrode and the pad includes an electric pattern for electric connection and at least one dummy pattern that is provided around the electric pattern to be separated the electric pattern.

22 Claims, 14 Drawing Sheets

ELECTRO ACOUSTIC TRANSDUCER

CROSS-REFERENCE TO RELATED APPLICATION

This application claims priority from Korean Patent Application No. 10-2014-0016281, filed on Feb. 12, 2014, in the Korean Intellectual Property Office, the disclosure of which is incorporated herein in its entirety by reference.

BACKGROUND

1. Field

Apparatuses and methods consistent with exemplary embodiments relate to an electro-acoustic transducer, and more particularly, to a micromachined capacitive electro-acoustic transducer.

2. Description of the Related Art

Electro-acoustic transducers convert electric energy to acoustic energy or vice versa and may include, for example, ultrasonic transducers and microphones. Micromachined electro-acoustic transducers use a micro-electro-mechanical system (MEMS). An example of the micromachined electro-acoustic transducer is a micromachined ultrasonic transducer (MUT), which is a device that converts an electric signal to an ultrasonic signal or vice versa. An MUT may be classified into a piezoelectric MUT (pMUT), a capacitive MUT (cMUT), and a magnetic MUT (mMUT), according to the signal converting method. Among these ultrasonic transducers, a cMUT is widely used in medical image diagnostic devices and/or sensors.

SUMMARY

Exemplary embodiments may address at least the above problems and/or disadvantages and other disadvantages not described above. However, exemplary embodiment are not required to overcome the disadvantages described above, and may not overcome any of the problems described above.

One or more exemplary embodiments provide a micromachined capacitive electro-acoustic transducer.

According to an aspect of an exemplary embodiment, an electro-acoustic transducer includes a conductive substrate provided with at least one cell and at least one electrode, and a pad substrate disposed corresponding to the conductive substrate and provided with at least one pad corresponding to the at least one electrode, in which at least one of the at least one electrode and the at least one pad includes an electric pattern for electric connection and at least one dummy pattern that is provided around the electric pattern to be separated therefrom.

The at least one electrode may include an electric electrode for electric connection and at least one dummy electrode that is provided around the electric electrode to be separated therefrom. The at least one pad may include an electric pad that is bonded to the electric electrode and at least one dummy pad that is provided around the electric pad to be separated therefrom and is bonded to the at least one dummy electrode.

The at least one dummy electrode may be provided to have a one-to-one correspondence with the at least one dummy pad. One dummy electrode may correspond to a plurality of dummy pads or a plurality of dummy electrodes may correspond to one dummy pad. The at least one pad may be formed as an integral type electric pad and bonded to the electric electrode and the at least one dummy electrode. The at least one pad may include an electric pad for electric connection and at least one dummy pad that is provided around the electric pad to be separated therefrom, and the at least one electrode may be formed as an integral type electric electrode and bonded to the electric pad and the at least one dummy pad.

The at least one dummy pattern may be provided to surround the electric pattern. The at least one dummy pattern may have a continuous line shape. The at least one dummy pattern may have at least one of a dotted line shape and a dashed line shape. The at least one electrode and the at least one pad may be bonded to each other by eutectic bonding. Any one of the at least one electrode and the at least one pad may include Sn and at least one of Au, Cu, and Ag, and the other one of the at least one electrode and the at least one pad may include at least one of Au, Cu, and Ag.

An area of the electric pattern may be about 2500~40000 $\mu m^2$, and a width of the at least one dummy pattern may be about 3~50 μm. An interval between the electric pattern and the at least one dummy pattern or an interval between dummy patterns may be about 3~50 μm.

According to another aspect of an exemplary embodiment, an electro-acoustic transducer includes a conductive substrate provided with a plurality of electrodes on one surface of the conductive substrate, and a pad substrate disposed corresponding to the conductive substrate and provided with a plurality of pads corresponding to the plurality of electrodes, in which at least one of the plurality of electrodes may include an electric electrode for electric connection and at least one dummy electrode that is provided around the electric electrode to be separated therefrom.

According to another aspect of an exemplary embodiment, an electro-acoustic transducer includes a conductive substrate provided with at least one cell and at least one electrode, a pad substrate disposed corresponding to the conductive substrate and provided with at least one pad corresponding to the at least one electrode, a support provided on the conductive substrate and forming the at least one cell, a membrane provided on the support to cover the at least one cell, and an upper electrode provided on the membrane, in which at least one of the at least one electrode and the at least one pad may include an electric pattern for electric connection and at least one dummy pattern that is provided around the electric pattern to be separated therefrom.

BRIEF DESCRIPTION OF THE DRAWINGS

The above and/or other aspects will become more apparent by describing in detail certain exemplary embodiments, with reference to the accompanying drawings, in which.

DETAILED DESCRIPTION

Figure 1:
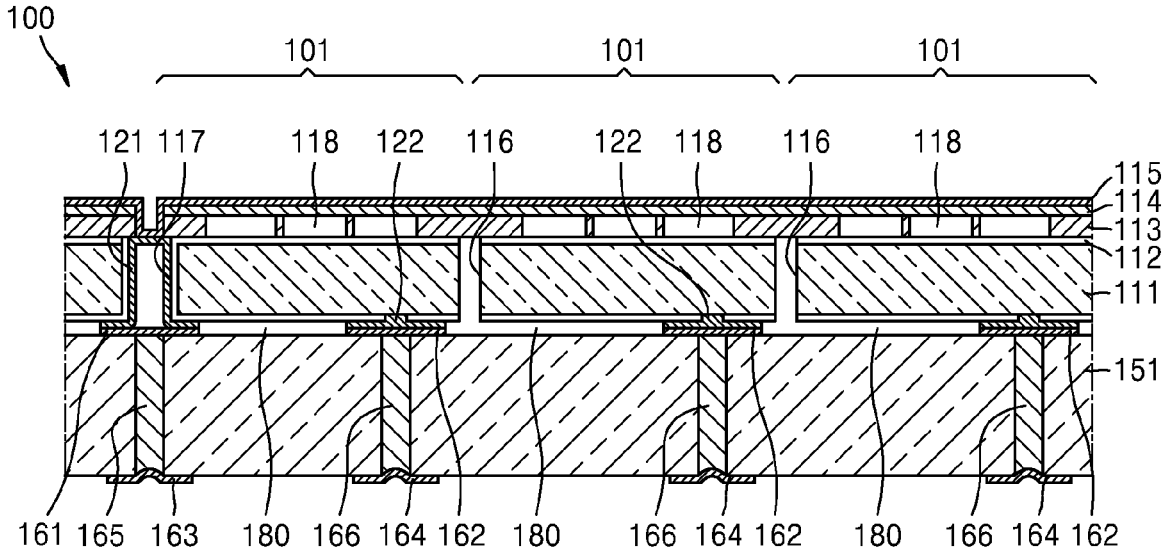
FIG. 1 is a cross-sectional view of an example of a micromachined capacitive electro-acoustic transducer.

Certain exemplary embodiments are described in greater detail below with reference to the accompanying drawings.

In the following description, same reference numerals are used for the same elements when they are depicted in different drawings. The matters defined in the description, such as detailed construction and elements, are provided to assist in a comprehensive understanding of exemplary embodiments. Thus, it is apparent that exemplary embodiments can be carried out without those specifically defined matters. Also, functions or elements known in the related art are not described in detail since they would obscure the exemplary embodiments with unnecessary detail.

The thickness or size of each layer illustrated in the drawings may be exaggerated for convenience of explanation and clarity. In the following description, when a layer is described to exist on another layer, the layer may exist directly on the other layer or a third layer may be interposed therebetween. A material forming each layer in the following exemplary embodiments is merely exemplary and thus another material may be used.

Expressions such as "at least one of," when preceding a list of elements, modify the entire list of elements and do not modify the individual elements of the list.

FIG. 1 is a cross-sectional view of an example of a micromachined capacitive electro-acoustic transducer 100. Referring to FIG. 1, the electro-acoustic transducer 100 includes a plurality of elements 101 that are arranged in two dimensions and each of the elements 101 includes at least one of cells 118. The elements 101 are separated from one another by a trench line 116. A support 113 in which the cells 118 are formed is provided on a conductive substrate 111. A membrane 114 that covers the cells 118 is provided on the support 113. An upper electrode 115 is provided on the membrane 114. An insulation layer 112 may be provided on a surface of the conductive substrate 111. A via hole 117 penetrates through the conductive substrate 111. A first electrode 121 is electrically connected to the upper electrode 115 via the via hole 117. The first electrode 121 is provided to extend to a lower surface of the conductive substrate 111. A plurality of second electrodes 122 are provided on a lower surface of the conductive substrate 111 to be electrically connected to the conductive substrate 111. The first electrode 121 may be a common electrode and the second electrodes 122 may be provided to correspond to the elements 101.

The conductive substrate 111 may be coupled to a pad substrate 151. In detail, a first pad 161 corresponding to the first electrode 121 and a plurality of second pads 162 corresponding to the second electrodes 122 are provided on an upper surface of the pad substrate 151. The first electrode 121 and the first pad 161 are bonded to each other and the second electrodes 122 and the second pads 162 are bonded to each other. The bonding between the first electrode 121 and the first pad 161 and the bonding between the second electrodes 122 and the second pads 162 may be performed by eutectic bonding. A first lower pad 163 connected to the first pad 161 and a plurality of second lower pads 164 connected to the second pads 162 are provided on a lower surface of the pad substrate 151. A first conductive filler 165 for electrically connecting the first pad 161 and the first lower pad 163 is provided in the pad substrate 151. A plurality of second conductive fillers 166 for electrically connecting the second pads 162 and the second lower pads 164 are provided in the pad substrate 151.

Figure 2:
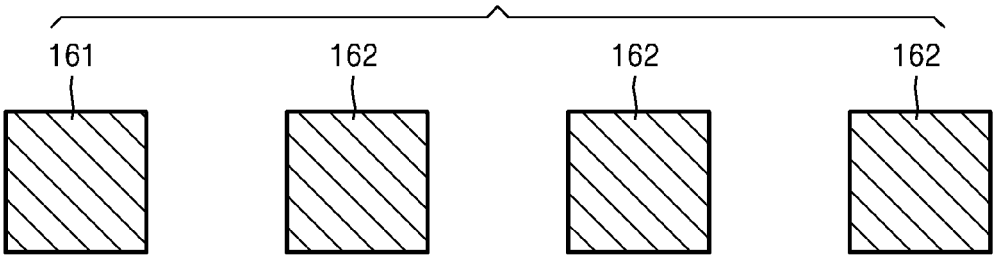
FIG. 2 illustrates plan views of first and second pads of FIG. 1.

As described above, the first electrode 121 of the conductive substrate 111 and the first pad 161 of the pad substrate 151 are bonded together. The second electrodes 122 of the conductive substrate 111 and the second pads 162 of the pad substrate 151 are bonded together. FIG. 2 illustrates planes of the first pad 161 and the second pads 162 of FIG. 1. Referring to FIGS. 1 and 2, cavity areas 180 that are relatively large spaces are formed between the first and second electrodes 121 and 122 (or the first and second pads 161 and 162) that are bonded together. The cavity areas 180 may generate unnecessary vibrations of the conductive substrate 111 during driving of the electro-acoustic transducer 100. Accordingly, a frequency response characteristic may be degraded.

Figure 3:
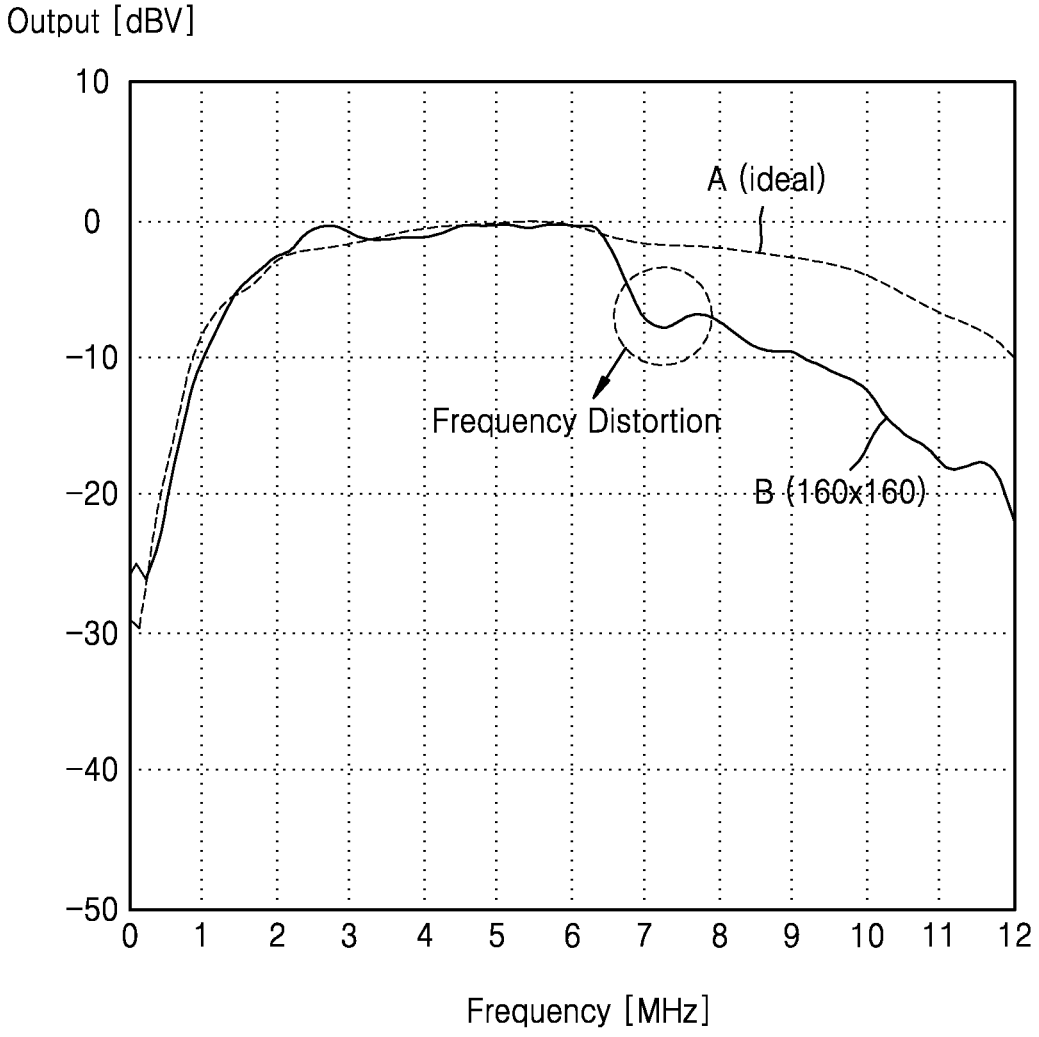
FIG. 3 is a graph showing frequency response characteristics of the micromachined capacitive electro-acoustic transducer of FIG. 1.

FIG. 3 is a graph showing frequency response characteristics of the micromachined capacitive electro-acoustic transducer 100 of FIG. 1. In detail, in FIG. 3, while a line A indicates an ideal frequency response characteristic of a micromachined capacitive electro-acoustic transducer, a line B indicates a frequency response characteristic occurring when a bonding area between the first and second electrodes 121 and 122 and the first and second pads 161 and 162 in the micromachined capacitive electro-acoustic transducer 100 of FIG. 1 is about 160 μm×160 μm. Referring to FIG. 3, it may be seen that, while the line A indicates an ideal frequency characteristic without frequency distortion, the line B has a frequency distortion phenomenon. The frequency distortion phenomenon may occur when the conductive substrate 111 vibrates due to the cavity areas 180 that are empty spaces existing between the bonding areas in the micromachined capacitive electro-acoustic transducer 100 of FIG. 1. As such, in the micromachined capacitive electro-acoustic transducer 100 of FIG. 1, the frequency response characteristic may be degraded due to the cavity areas 180 that are relatively large empty spaces existing between the bonding areas.

Figure 4:
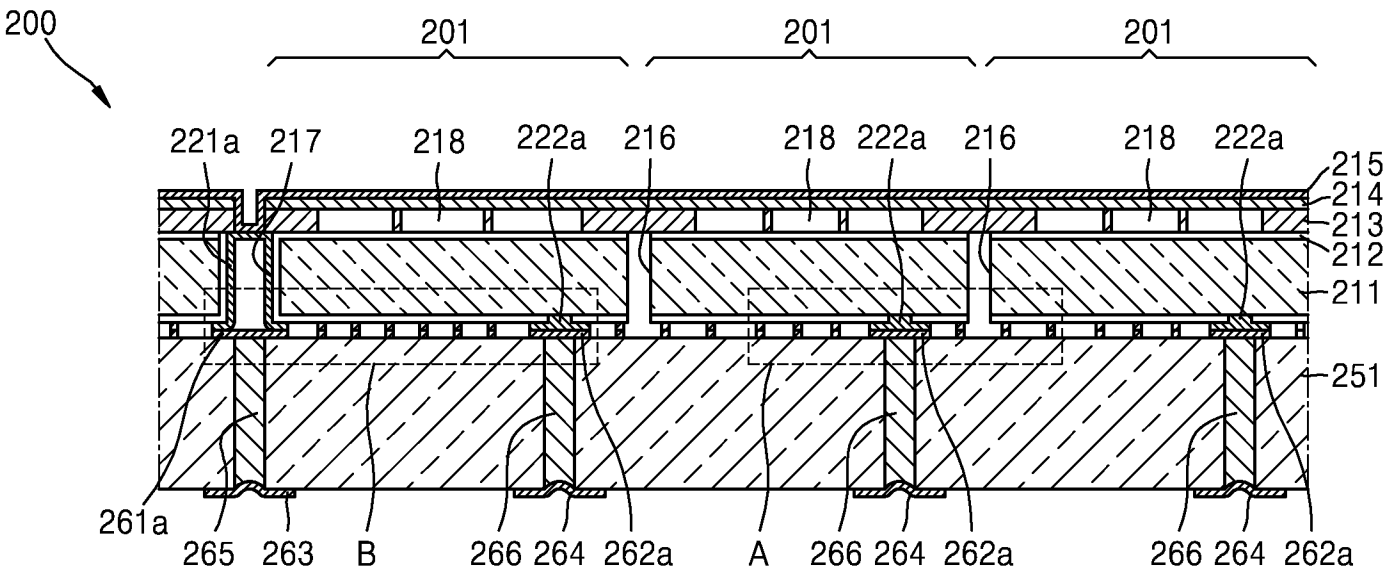
FIG. 4 is a cross-sectional view of a micromachined capacitive electro-acoustic transducer according to an exemplary embodiment.
Figure 5:
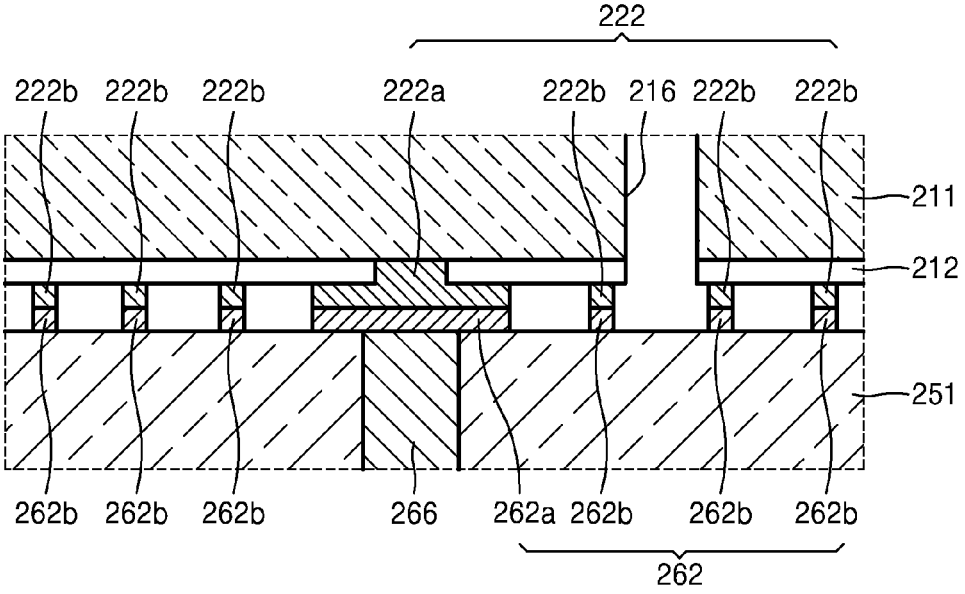
FIG. 5 is an enlarged view of a portion A of FIG. 4.
Figure 6:
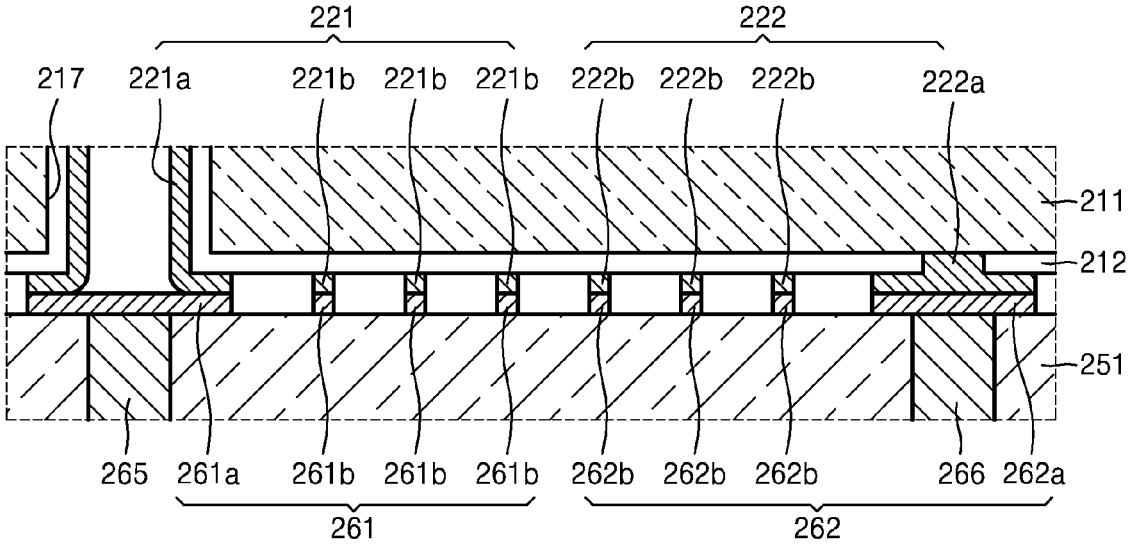
FIG. 6 is an enlarged view of a portion B of FIG. 4.

FIG. 4 is a cross-sectional view of a micromachined capacitive electro-acoustic transducer 200 according to an exemplary embodiment. FIG. 4 illustrates a part of the electro-acoustic transducer 200 for convenience of explanation. FIG. 5 is an enlarged view of a portion A of FIG. 4. FIG. 6 is an enlarged view of a portion B of FIG. 4.

Referring to FIGS. 4 to 6, the electro-acoustic transducer 200 includes a plurality of elements 201 that are arranged in two dimensions. Each of the elements 201 includes at least one of cells 218. Each of the elements 201 may be independently driven. Although FIG. 4 illustrates an example in which each of the elements 201 includes the cells 218, each of the elements 201 may include one cell 218 only. The elements

201 are separated from one another by a trench line 216 to prevent crosstalk and electrical connection between the elements 201.

The electro-acoustic transducer 200 includes a conductive substrate 211 having the cells 218 on an upper surface thereof and a plurality of first and second electrodes 221 and 222 on a lower surface thereof, and a pad substrate 251 coupled to the conductive substrate 211 and having on an upper surface thereof a plurality of pads 261 and 262 that are bonded to the first and second electrodes 221 and 222. The first and second electrodes 221 and 222 and the pads 261 and 262 respectively includes an electric pattern for electric connection and at least one dummy pattern provided around the electric pattern to be separated from the electric pattern.

The conductive substrate 211 functions as a low electrode and may include, for example, a low resistance silicon substrate. However, this is merely an example and a substrate formed of various materials may be used as the conductive substrate 211. An insulation layer 212 may be formed on an upper surface of the conductive substrate 211. Although the insulation layer 212 may include, for example, silicon oxide, an exemplary embodiment is not limited thereto. A support 213 on which the cells 218 are formed is provided on the insulation layer 212. Although the support 213 may include, for example, silicon oxide, an exemplary embodiment is not limited thereto. A membrane 214 is provided on the support 213 to cover the cells 218. Although the membrane 214 may include, for example, silicon, an exemplary embodiment is not limited thereto. An upper electrode 215 is provided on the membrane 214.

A via hole 217 is formed to penetrate through the conductive substrate 211 and insulation layer 212. The insulation layer 212 is formed on an inner wall of the via hole 217. The first electrode 221, more specifically, a first electric electrode 221*a* described later in detail, may be provided on the inner wall and an upper wall of the via hole 217. The first electrode 221 may extend to a lower surface of the conductive substrate 211. The first electrode 221 is electrically connected to the upper electrode 215. A trench to expose the first electrode 221 is formed in the membrane 214 and the support 213. The upper electrode 215 is connected to the first electrode 221 through the trench. The insulation layer 212 is formed on a lower surface of the conductive substrate 211. The insulation layer 212 is patterned to expose a part of the lower surface of the conductive substrate 211. The second electrodes 222 are provided on the insulation layer 212 to be electrically connected to the exposed lower surface of the conductive substrate 211. FIG. 4 illustrates an example in which the first electrode 221 is provided to be a common electrode and the second electrode 222 corresponds to the element 201. Alternatively, the first electrode 221 may be provided to correspond to the element 201 and the second electrode 222 may be provided to be a common electrode.

Each of the first electrode 221 and the second electrodes 222 includes an electric pattern for electric connection and at least one dummy pattern provided around the electric pattern to be separated therefrom. In detail, the first electrode 221 includes a first electric electrode 221*a* and at least one first dummy electrode 221*b* provided around the first electric electrode 221*a* to be separated therefrom. Each of the second electrodes 222 includes a second electric electrode 222*a* and at least one second dummy electrode 222*b* provided around the second electric electrode 222*a* to be separated therefrom.

Figure 7A:
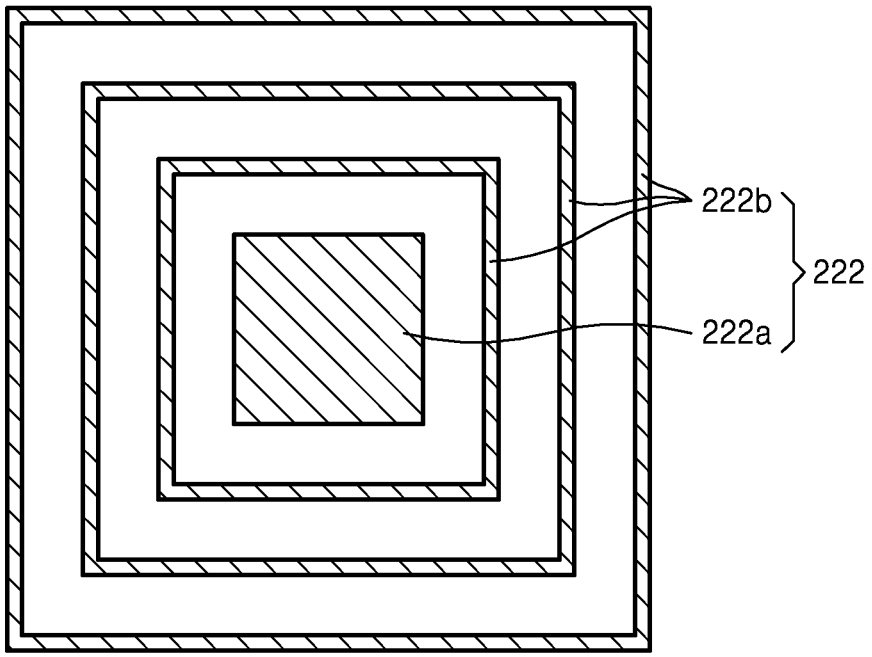
FIGS. 7A and 7B illustrate a plan view of a second electrode (or second pad) of FIG. 4.

FIG. 7A illustrates a plan view of the second electrode 222 of FIG. 4. The second electrode 222 includes the second electric electrode 222*a* for electric connection and second dummy electrodes 222*b* provided around the second electric electrodes 222*a* to be separated therefrom. As described below, the second electric electrode 222*a* is bonded to a second electric pad 262*a* and the second dummy electrodes 222*b* are bonded to the second dummy pads 262*b*. The second electric electrode 222*a* is provided to contact a lower surface of the conductive substrate 211 to transfer an electric signal applied from the second electric pad 262*a* to the conductive substrate 211 that is a lower electrode. The second dummy electrodes 222*b* are bonded to the second dummy pads 262*b* and support the conductive substrate 211 and pad substrate 251 between the first electric electrode 221*a* and second electric electrode 222*a* (or a first electric pad 261*a* and the second electric pad 262*a*) and between the second electric electrodes 222*a* (or the second electric pads 262*a*).

Each of the second dummy electrodes 222*b* may have a continuous line shape surrounding the second electric electrode 222*a*. The second dummy electrodes 222*b* may be provided to be separated from each other at predetermined intervals. For example, the size of the second electric electrode 222*a* may be about 50×50~200×200 $\mu m^2$. In this case, each of the second dummy electrodes 222*b* may be formed to have a width of about 3~50 μm. The interval between the first electric electrode 222*a* and the second dummy electrodes 222*b* or the interval between the second dummy electrodes 222*b* may be about 3~50 μm. However, an exemplary embodiment is not limited thereto and the second electric electrode 222*a* and the second dummy electrodes 222*b* may be formed in various sizes. Although FIG. 7A illustrates that the second dummy electrodes 222*b* are provided around the second electric electrode 222*a*, only one second dummy electrode 222*b* may be provided around the second electric electrode 222*a*. The second electrode 222 formed of the second electric electrode 222*a* and the second dummy electrodes 222*b* may include a conductive material. The second electrode 222 may include, for example, at least one of Au, Cu, and Ag. Also, the second electrode 222 may include, for example, Sn and at least one of Au, Cu, and Ag.

The first electrode 221 formed on the lower surface of the conductive substrate 211 has the same plan view as that of the second electrode 222 of FIG. 7A, except that a through hole corresponding to the via hole 217 is formed in the middle of the first electrode 221. The first electrode 221 includes the first electric electrode 221*a* for electric connection and the first dummy electrodes 221*b* provided around the first electric electrode 221*a* to be separated therefrom. As described below, the first electric electrode 221*a* is bonded to the first electric pad 261*a* and the first dummy electrodes 221*b* are bonded to a plurality of first dummy pads 261*b*. The first electric electrode 221 is provided to contact the upper electrode 215 and transfers an electric signal applied from the first electric pad 261*a* to the upper electrode 215. The first dummy electrodes 221*b* are bonded to the first dummy pads 261*b* and support the conductive substrate 211 and the pad substrate 251 between the first electric electrode 221*a* and the second electric electrode 222*a* (or the first electric pad 261*a* and the second electric pad 262*a*) and between the conductive substrate 211 and the pad substrate 251.

Each of the first dummy electrodes 221*b* may have a continuous line shape surrounding the first electric electrode 221*a*. The first dummy electrodes 221*b* may be provided to be separated from each other at predetermined intervals. For example, the size of the first electric electrode 221*a* may be about 50×50~200×200 $\mu m^2$. In this case, each of the first dummy electrodes 221*b* may be formed to have a width of about 3~50 μm. The interval between the first electric electrode 221*a* and the second dummy electrode 221*b* or between the first dummy electrodes 221*b* may be about 3~50 μm.

However, an exemplary embodiment is not limited thereto and the first electric electrode 221*a* and the first dummy electrodes 221*b* may be formed in various sizes. Alternatively, only one first dummy electrode 221*b* may be provided around the first electric electrode 221*a*. The first electrode 221 formed of the first electric electrode 221*a* and the first dummy electrodes 221*b* may include a conductive material. The first electrode 221 may include, for example, at least one of Au, Cu, and Ag. Also, the first electrode 221 may include, for example, Sn and at least one of Au, Cu, and Ag.

Figure 8A:
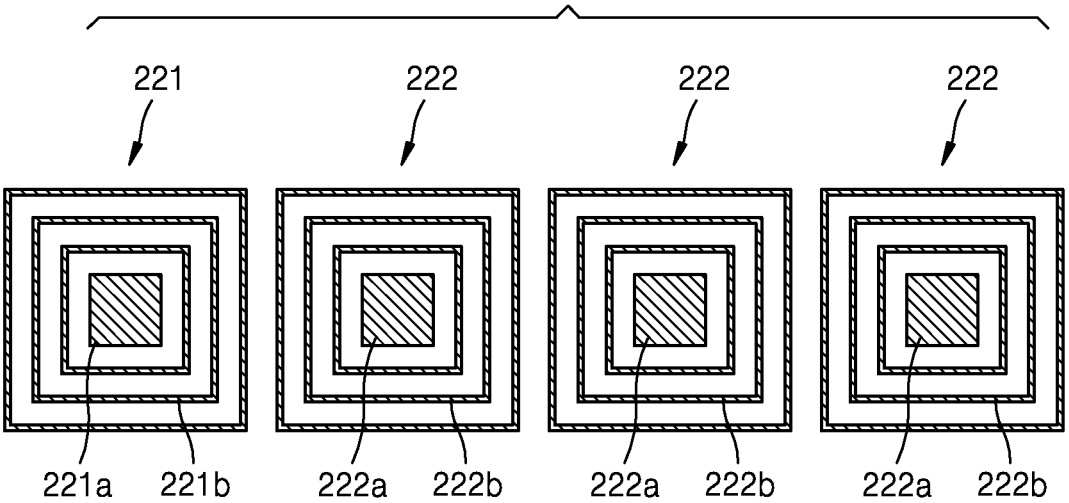
FIGS. 8A and 8B illustrate plan views of first and second electrodes (or first and second pads of FIG. 4.

FIG. 8A illustrates plan views of the first and second electrodes 221 and 222 of FIG. 4. The first dummy electrodes 221*b* and the second dummy electrodes 222*b* are disposed between the first electric electrode 221*a* and second electric electrode 222*a* and the second dummy electrodes 222*b* are disposed between the second electric electrodes 222*a*.

The pad substrate 251 is coupled to a lower portion of the conductive substrate 211. A silicon substrate, for example, may be used as the pad substrate 251, but an exemplary embodiment is not limited thereto. The first pad 261 bonded to the first electrode 221 and the second pads 262 bonded to the second electrodes 222 are provided on an upper surface of the pad substrate 251.

Figure 7B:
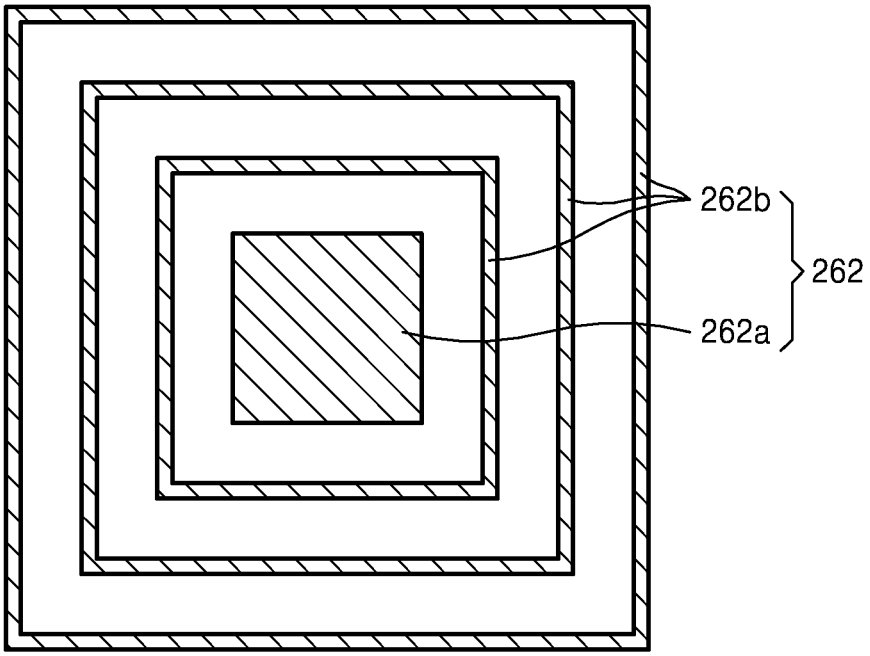

FIG. 7B illustrates a plan view of the second pad 262. The second pad 262 includes the second electric pad 262*a* for electric connection and the second dummy pads 262*b* provided around the second electric pad 262*a* to be separated therefrom. The second dummy pads 262*b* may be provided to have a one-to-one correspondence with the second dummy electrodes 222*b*. The second electric pad 262*a* is bonded to the second electric electrode 222*a* and the second dummy pads 262*b* are bonded to the second dummy electrodes 222*b*. The second electric pad 262*a* applies an electric signal to the conductive substrate 211 that is a lower electrode, via the second electric electrode 222*a*. The second dummy pads 262*b* are bonded to the second dummy electrodes 222*b* and supports the conductive substrate 211 and the pad substrate 251 between the first electric electrode 221*a* and the second electric electrode 222*a* (or the first electric pad 261*a* and the second electric pad 262*a*) and between the second electric electrodes 222*a* (or the second electric pads 262*a*).

Each of the second dummy pads 262*b* may have a continuous line shape surrounding the second electric pad 262*a*. The second dummy pads 262*b* may be provided to be separated from each other at predetermined intervals. The second electric pad 262*a* and the second dummy pads 262*b* may have sizes corresponding to those of the above-described second electric electrode 222*a* and second dummy electrodes 222*b*. Although FIG. 7B illustrates that the second dummy pads 262*b* are provided around the second electric pad 262*a*, only one second dummy pad 262*b* may be provided around the second electric pad 262*a*. The second pad 262 formed of the second electric pad 262*a* and the second dummy pads 262*b* may include a conductive material. The second pad 262 may include, for example, Sn and at least one of Au, Cu, and Ag. Also, the second pad 262 may include, for example, at least one of Au, Cu, and Ag.

The second pad 262 and the second electrode 222, that is, the second electric pad 262*a* and the second electric electrode 222*a*, and the second dummy pads 262*b* and the second electric electrodes 222*b* may be bonded to each other by eutectic bonding. For example, when the second pad 262 is formed of an Au/Sn layer and the second electrode 222 is formed of an Au layer, or the second pad 262 is formed of an Au layer and the second electrode 222 is formed of an Au/Sn layer, if the second pad 262 and the second electrode 222 are eutectic bonded, an Au—Sn alloy may be formed on a boundary surface between the second pad 262 and the second electrode 222. Alternatively, the second pad 262 and the second electrode 222 may be bonded in various bonding methods in addition to the above-described eutectic bonding method.

The first pad 261 has the same plan view as that of the second pad 262 of FIG. 7B. The first pad 261 includes the first electric pad 261*a* for electric connection and the first dummy pads 261*b* provided around the first electric pad 261*a* to be separated therefrom. The first dummy pads 261*b* may have a one-to-one correspondence with the first dummy electrodes 221*b*. The first electric pad 261*a* is bonded to the first electric electrode 221*a* and the first dummy pads 261*b* are bonded to the first dummy electrodes 221*b*. The first electric pad 261*a* applies an electric signal to the upper electrode 215 via the first electric electrode 221*a*. The first dummy pads 261*b* are bonded to the first dummy electrodes 221*b* and support the conductive substrate 211 and the pad substrate 251 between the first electric electrode 221*a* and the second electric electrode 221*b* (or the first electric pad 261*a* and the second electric pad 262*a*). Each of the first dummy pads 261*b* may have a continuous line shape surrounding the first electric pad 261*a*. The first dummy pads 261*b* may be provided to be separated from each other at predetermined intervals. The first electric pad 261*a* and the first dummy pads 261*b* may have sizes corresponding to those of the above-described first electric electrode 221*a* and first dummy electrodes 221*b*. Alternatively, only one first dummy pad 261*b* may be provided around the first electric pad 261*a*.

The first pad 261 formed of the first electric pad 261*a* and the first dummy pads 261*b* may include a conductive material. The first pad 261 may include, for example, at least one of Au, Cu, and Ag. Also, the first pad 261 may include, for example, Sn and at least one of Au, Cu, and Ag. Like the bonding of the second pad 262 and the second electrode 222, the first pad 261 and the first electrode 221, that is, the first electric pad 261*a* and the first electric electrode 221*a*, and the first dummy pads 261*b* and the first dummy electrodes 221*a*, may be bonded by eutectic bonding. However, an exemplary embodiment is not limited thereto.

Figure 8B:
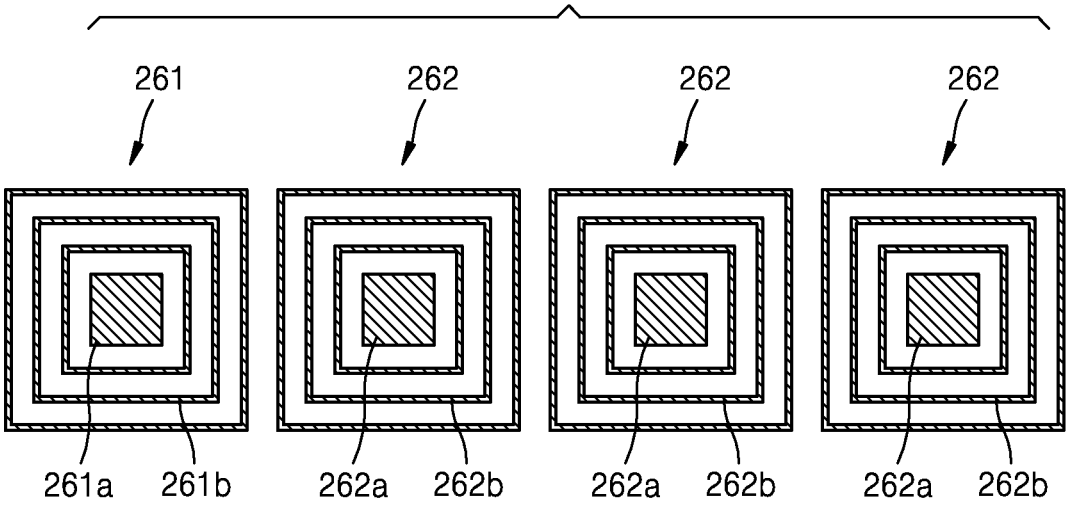

FIG. 8B illustrates plan views of the first pad 261 and the second pads 262 of FIG. 4. The first dummy pads 261*b* and the second dummy pads 262*b* are disposed around the first electric pad 261*a* and the second electric pad 262*a*.

A first lower pad 263 and a plurality of second lower pads 264 may be provided on a lower surface of the pad substrate 251. The first lower pad 263 is electrically connected to the first electric pad 261*a* of the first pad 261. The second lower pads 264 are electrically connected to the second electric pads 262*a* of the second pads 262. To this end, a plurality of through holes are formed in the pad substrate 251. The through holes may be provided with a first conductive filler 265 for connecting the first electric pad 261*a* and the first lower pad 263 and second conductive fillers 266 for connecting the second electric pads 262*a* and the second lower pads 264. Meanwhile, although it is not illustrated in the drawings, a driving circuit substrate, for example, an application specific integrated circuit (ASIC) substrate, for applying an electric signal to the first and second lower pads 263 and 264 may be provided under the pad substrate 251.

As described above, a first dummy pattern, that is, the first dummy electrode 221*b* and the first dummy pad 261*b* that are bonded to each other, and a second dummy pattern, that is, the second dummy electrodes 222*b* and the second dummy pad 262*b* that are bonded to each other, support the conductive substrate 211 and the pad substrate 251 in an empty space between the first electric electrode 221*a* and the second electric electrode 222*a* (or the first electric pad 261*a* and the second electric pad 262*a*). The second dummy pattern, that is, the second dummy electrodes 222*b* and the second dummy pad 262*b* that are bonded to each other, supports the conductive substrate 211 and pad substrate 251 in the empty space between the second electric electrodes 222*a* (or the second electric pads 262*a*). As such, unnecessary vibration of the conductive substrate 211 that may occur due to the empty space formed between the conductive substrate 211 and the pad substrate 251 may be prevented by the support of the first and second dummy patterns. Accordingly, a superior frequency response characteristic may be obtained even in a wide frequency range. Also, since a bonding area may be reduced, a pressure applied to a unit area during bonding may be reduced and also a short circuit that may occur between adjoining electrodes may be prevented. Alternatively, although the above description describes that the pad substrate 251 is used as a substrate that electrically connects the conductive substrate 211 and the driving circuit substrate, the pad substrate 251 may be used as the driving circuit substrate so as to be directly coupled to the conductive substrate 211.

Figure 9:
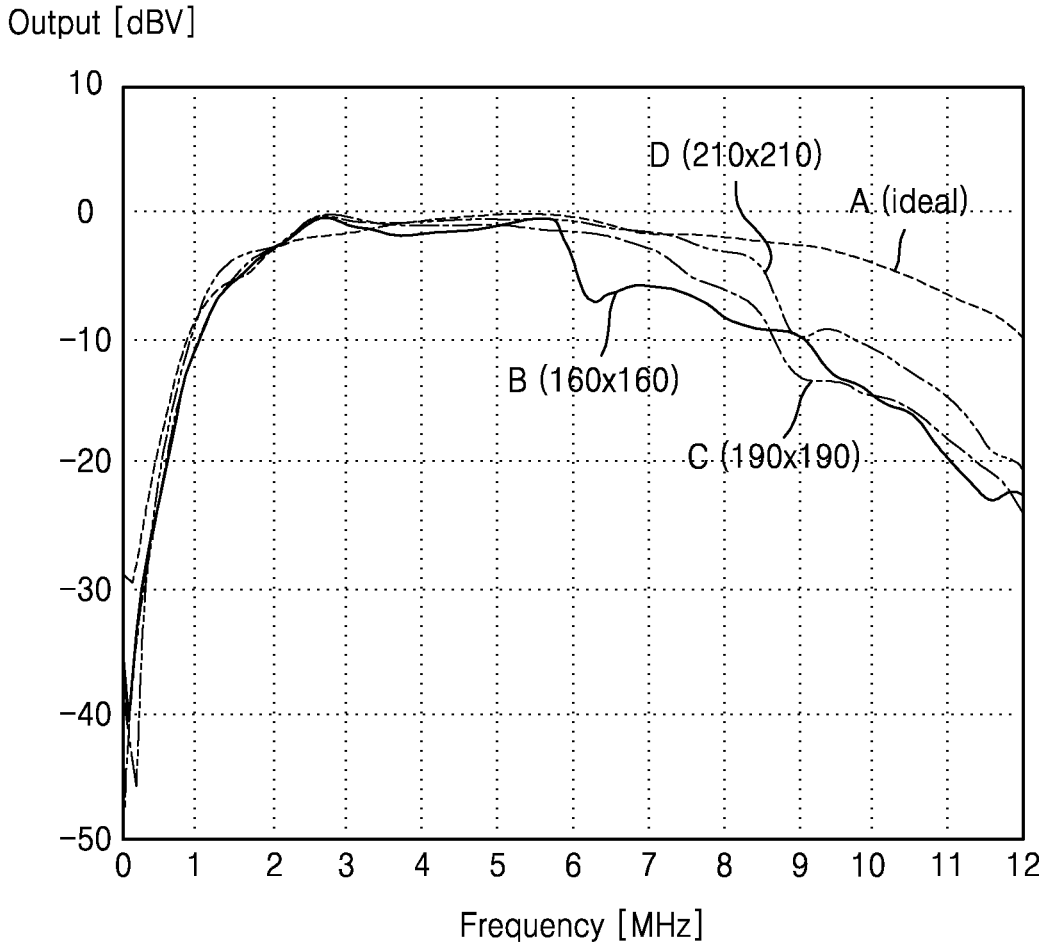
FIG. 9 is a graph showing frequency response characteristics of a micromachined capacitive electro-acoustic transducer according to a change in a bonding area.

FIG. 9 is a graph showing frequency response characteristics of a micromachined capacitive electro-acoustic transducer according to a change in a bonding area. In detail, in FIG. 9, a line A indicates an ideal frequency response characteristic of a micromachined capacitive electro-acoustic transducer and lines B, C and D indicate frequency response characteristics that occur when the bonding areas between the first and second electrodes 121 and 122 and the first and second pads 161 and 162 of the micromachined capacitive electro-acoustic transducer 100 of FIG. 1 are about 160 μm×160 μm, 190 μm×190 μm, and 210 μm×210 μm, respectively. Referring to FIG. 9, as indicated by the lines B, C and D, it may be seen that, when the bonding area is small, a frequency distortion phenomenon occurs in a low frequency range and, when a bonding area increases, the frequency distortion phenomenon occurs in a high frequency range. This is because the empty space existing between the bonding areas gradually decreases as the bonding area increases. Meanwhile, although the frequency distortion phenomenon may decrease as the bonding area increases, a possibility of a short circuit occurring between adjoining electrodes increases. In an exemplary embodiment, as dummy patterns are provided around electrode patterns, the empty space formed between the conductive substrate 211 and the pad substrate 251 may be greatly reduced. Accordingly, the frequency distortion phenomenon that occurs due to the unnecessary vibration of the conductive substrate 211 may be prevented and thus a superior frequency response characteristic may be obtained in a wide frequency range. Also, since the bonding area may be reduced, the short circuit that occurs between the adjoining electrodes may be prevented.

Figure 10A:
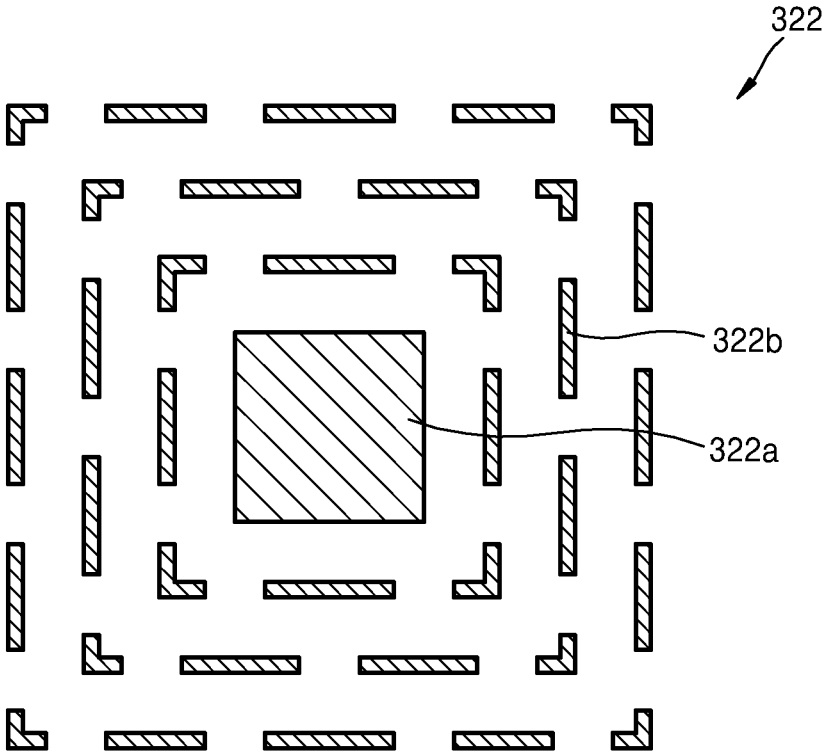
FIGS. 10A and 10B illustrate a plan view of a second electrode (or second pad) according to another exemplary embodiment.
Figure 10B:
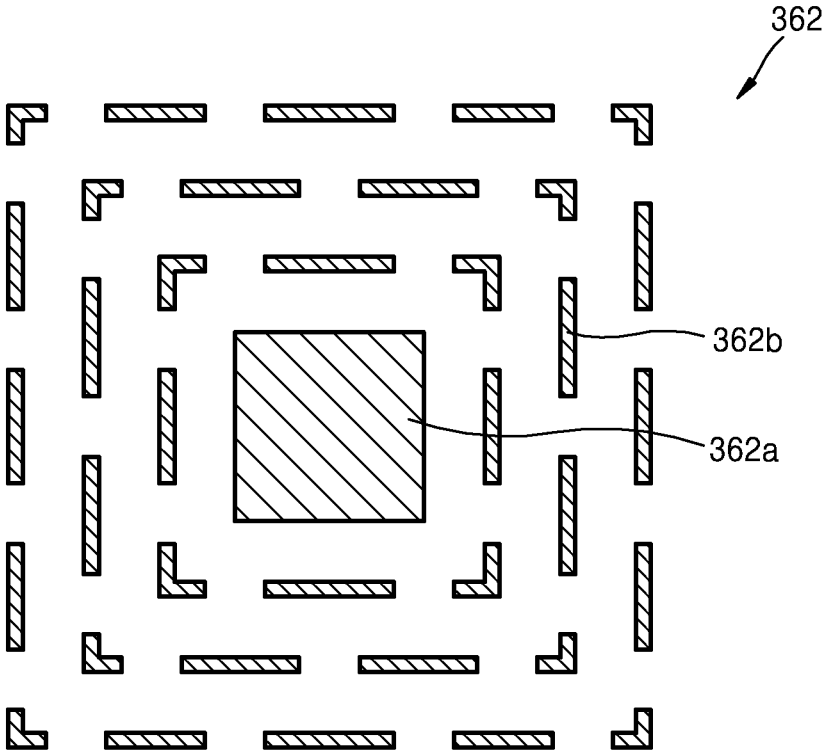

FIGS. 10A and 10B illustrate a plan view of a second electrode 322 (or a second pad 362) according to another exemplary embodiment. The second electrode 322 includes a second electric electrode 322*a* for electric connection and a plurality of second dummy electrodes 322*b* that are provided around the second electric electrode 322*a* to be separated therefrom. Each of the second dummy electrodes 322*b* may have a dashed line shape surrounding the second electric electrode 322*a*. Alternatively, only one second dummy electrode 322*b* may be provided around the second electric electrode 322*a*. The second pad 362 includes a second electric pad 362*a* for electric connection and a plurality of second dummy pads 362*b* that are provided around the second electric pad 362*a* to be separated therefrom. Each of the second dummy pads 362*b* may have a dashed line shape. Alternatively, only one second dummy pad 362*b* may be provided around the second electric pad 362*a*. The second electric electrode 322*a* is bonded to the second electric pad 362*a*. The second dummy electrodes 322*b* are bonded to the second dummy pads 362*b*. The second dummy electrodes 362*b* are bonded to the second dummy pads 322*b* and support the conductive substrate 211 and the pad substrate 251. Alternatively, a first electrode (not shown) that is connected to the upper electrode and a first pad (not shown) that is connected to the first electrode may have the same shapes as those of the above-described second electrode 322 and second pad 362.

Figure 11A:
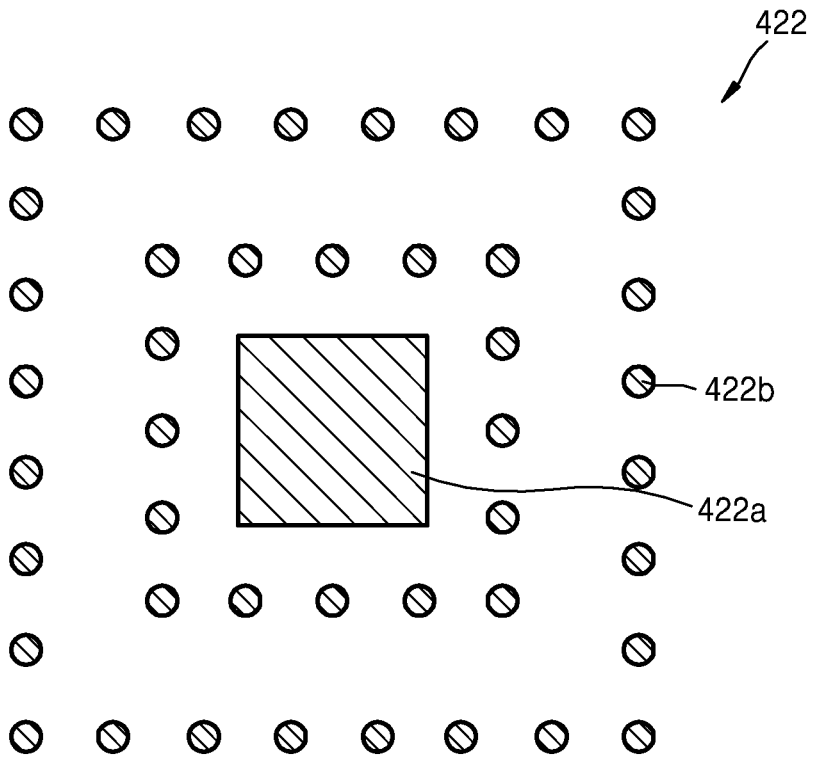
FIGS. 11A and 11B illustrate a plan view of a second electrode (or second pad) according to another exemplary embodiment.
Figure 11B:
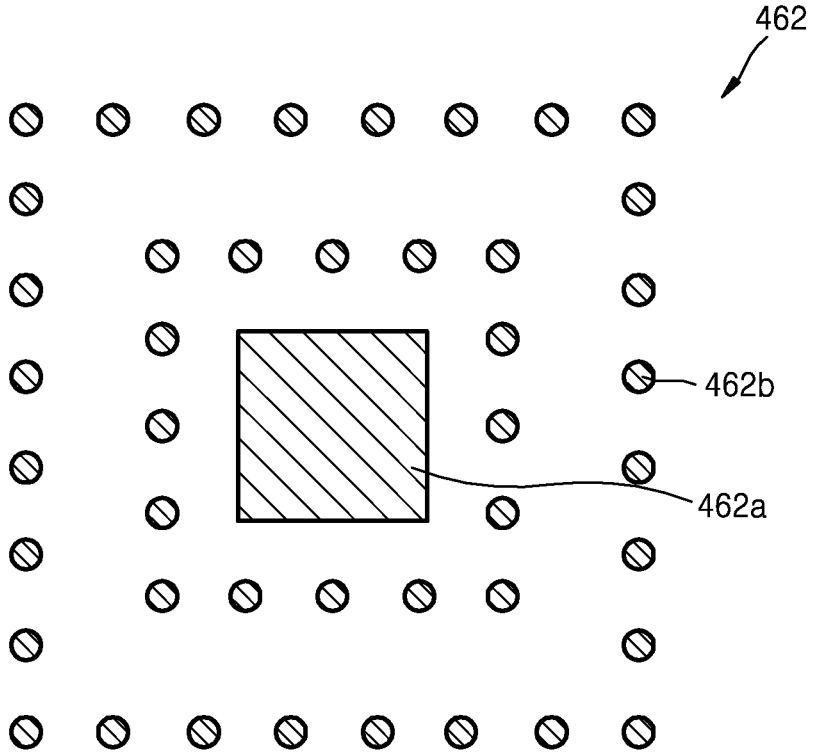

FIGS. 11A and 11B illustrate a plan view of a second electrode 422 (or a second pad 462) according to another exemplary embodiment. The second electrode 422 includes a second electric electrode 422*a* for electric connection and a plurality of second dummy electrodes 422*b* that are provided around the second electric electrode 422*a* to be separated therefrom. Each of the second dummy electrodes 422*b* may have a dotted line shape surrounding the second electric electrode 422*a*. Alternatively, only one second dummy electrode 422*b* may be provided around the second electric electrode 422*a*. The second pad 462 includes a second electric pad 462*a* for electric connection and a plurality of second dummy pads 462*b* that are provided around the second electric pad 462*a* to be separated therefrom. Each of the second dummy pads 462*b* may have a dotted line shape. Alternatively, only one second dummy pad 462*b* may be provided around the second electric pad 462*a*. The second electric electrode 422*a* is bonded to the second electric pad 462*a*. The second dummy electrodes 422*b* are bonded to the second dummy pads 462*b*. The second dummy electrodes 422*b* are bonded to the second dummy pads 462*b* and support the conductive substrate 211 and the pad substrate 251. A first electrode (not shown) that is connected to the upper electrode 215 and a first pad (not shown) that is bonded to the first electrode may have the same shapes as those of the above-described second electrode 422 and second pad 462. Alternatively, the second dummy electrode 422*b* and the second dummy pad 462*b* may have a dotted and dashed line shape, respectively.

Figure 12A:
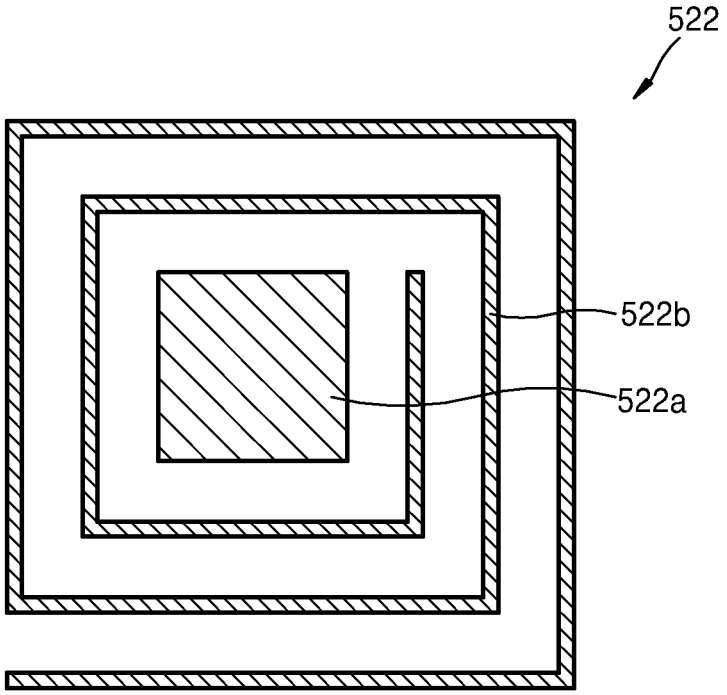
FIGS. 12A and 12B illustrate a plan view of a second electrode (or second pad) according to another exemplary embodiment.
Figure 12B:
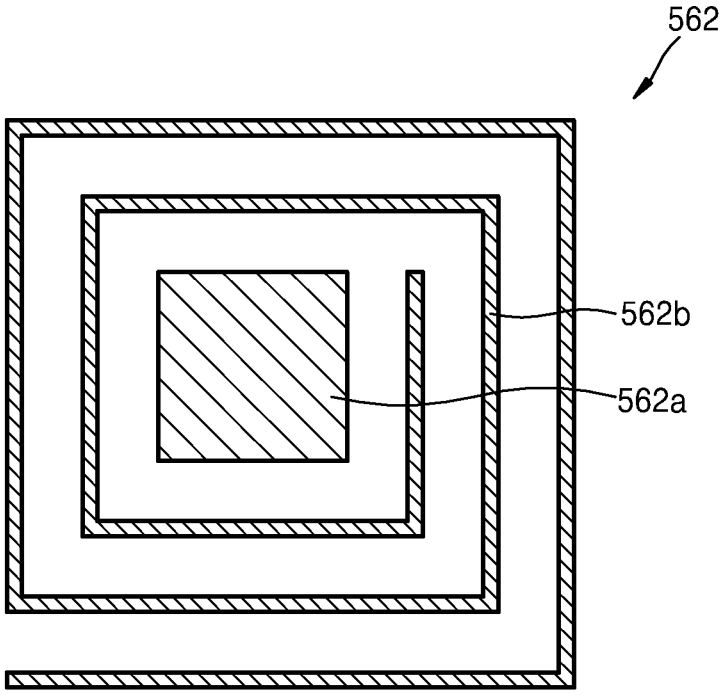

FIGS. 12A and 12B illustrate a plan view of a second electrode 522 (or a second pad 562) according to another exemplary embodiment. The second electrode 522 includes a second electric electrode 522*a* for electric connection and a second dummy electrode 522*b* that is provided around the second electric electrode 522*a* to be separated therefrom. The second dummy electrode 522*b* may have a spiral continuous line shape surrounding the second electric electrode 522*a*. The second pad 562 includes a second electric pad 562*a* for electric connection and a second dummy pad 562*b* that is provided around the second electric pad 562*a* to be separated therefrom. The second dummy pad 562*b* may have a spiral continuous line shape surrounding the second electric pad 562*a*. A first electrode (not shown) that is connected to the upper electrode 215 and a first pad (not shown) that is bonded to the first electrode may have the same shapes as those of the above-described second electrode 522 and second pad 562. In addition, the second electrode 522 and the second pad 562 may have a variety of shapes.

Figure 13:
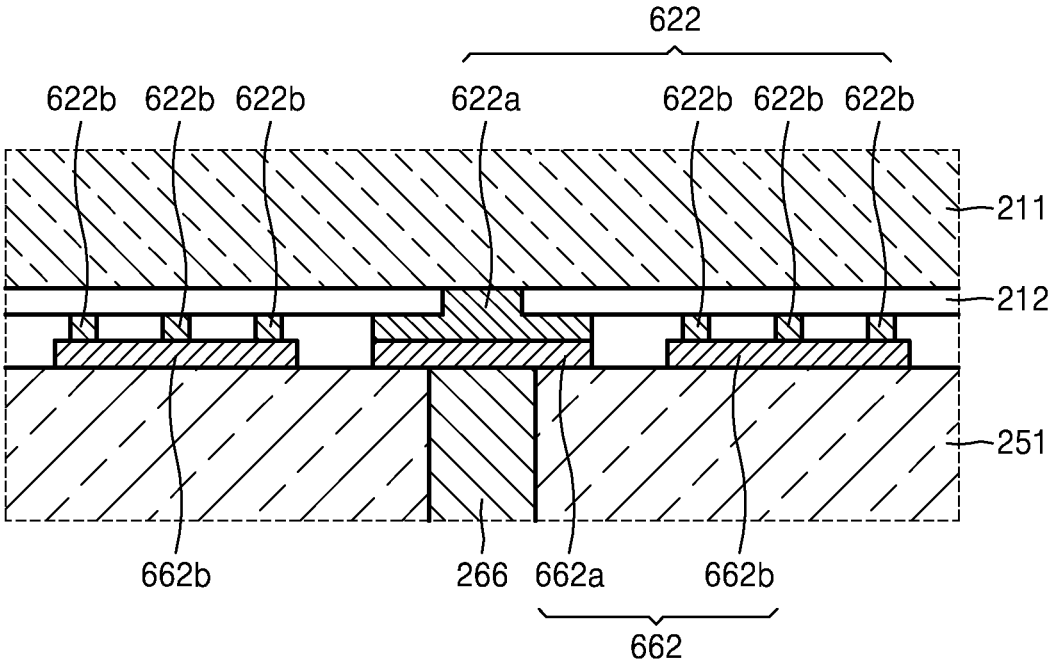
FIG. 13 is a cross-sectional view of a second electrode and a second pad according to another exemplary embodiment.
Figure 14:
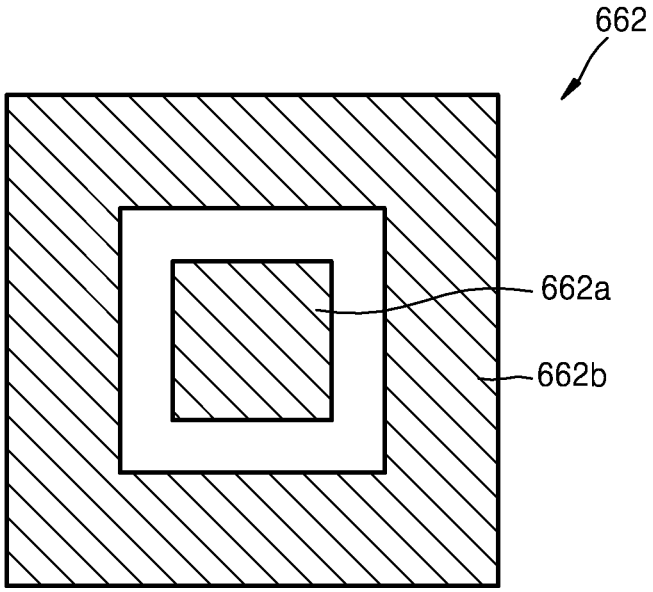
FIG. 14 illustrates a plan view of a second pad of FIG. 13.

FIG. 13 is a cross-sectional view of a second electrode 622 and a second pad 662 according to another exemplary embodiment. FIG. 14 illustrates a plan view of the second pad 662 of FIG. 13. Referring to FIGS. 13 and 14, the second electrode 622 includes a second electric electrode 622*a* for electric connection and a plurality of second dummy electrodes 622*b* that are provided around the second electric electrode 622*a* to be separated therefrom. Each of the second dummy electrodes 622*b* may have a variety of shapes such as a continuous line shape, a dotted line shape, or a dashed line shape. The second pad 662 includes a second electric pad 662*a* for electric connection and a second dummy pad 662*b* that is provided around the second electric pad 662*a* to be separated therefrom. The second dummy pad 662*b* is provided to correspond to the second dummy electrodes 622*b*. The second electric electrode 622*a* is bonded to the second electric pad 662*a*. The second dummy electrodes 622*b* is bonded to the second dummy pad 662*b*. The second dummy electrodes 622*b* are bonded to the second dummy pad 662*b* and support the conductive substrate 211 and the pad substrate 251. Meanwhile, a first electrode (not shown) that is connected to the upper electrode 215 may have the same shape as that of the second electrode 622 and a first pad (not shown) that is bonded to the first electrode may have the same shape as that of the second pad 662.

Figure 15:
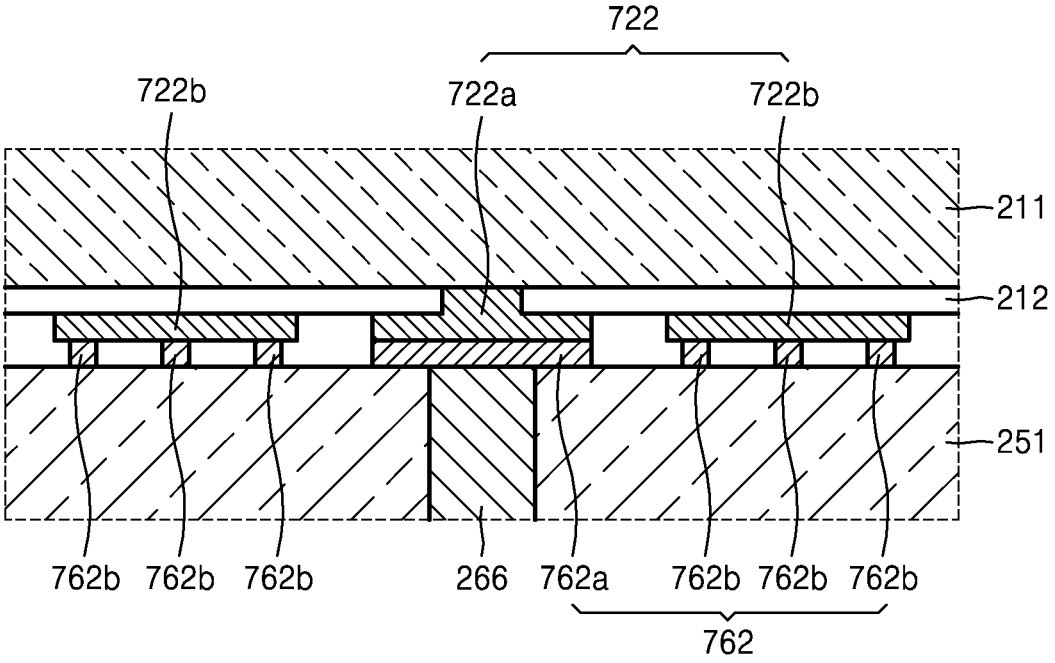
FIG. 15 is a cross-sectional view of a second electrode and a second pad according to another exemplary embodiment.

FIG. 15 is a cross-sectional view of a second electrode 722 and a second pad 762 according to another exemplary embodiment. Referring to FIG. 15, the second electrode 722 includes a second electric electrode 722*a* for electric connection and a second dummy electrode 722*b* that is provided around the second electric electrode 762*a* to be separated therefrom. The second electrode 722 has the same plane shape as that of the second pad 662 of FIG. 14. The second pad 762 includes a second electric pad 762*a* for electric connection and a plurality of second dummy pads 762*b* that are provided around the second electric pad 762*a* to be separated therefrom. The second dummy pads 762*b* are provided to correspond to one second dummy electrode 722*b*. Each of the second dummy pads 762*b* may have a variety of shapes such as a continuous line shape, a dotted line shape, or a dashed line shape. The second electric electrode 722*a* is bonded to the second electric pad 762*a*. The second dummy electrode 722*b* is bonded to the second dummy pads 762*b*. The second dummy electrode 722*b* is bonded to the second dummy pads 762*b* and supports the conductive substrate 211 and the pad substrate 251. Meanwhile, a first electrode (not shown) that is connected to the upper electrode 215 may have the same shape as that of the second electrode 722. A first pad that is bonded to the first electrode may have the same shape as that of the second pad 762.

Figure 16:
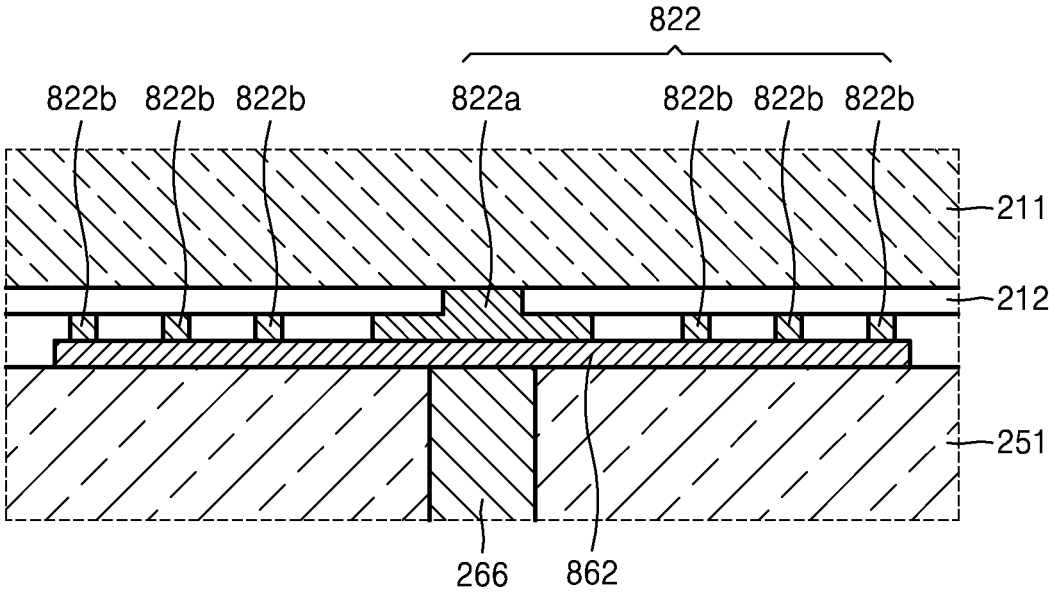
FIG. 16 is a cross-sectional view of a second electrode and a second pad according to another exemplary embodiment.

FIG. 16 is a cross-sectional view of a second electrode 822 and a second pad 862 according to another exemplary embodiment. Referring to FIG. 16, the second electrode 822 includes a second electric electrode 822*a* for electric connection and a plurality of second dummy electrodes 822*b* that are provided around the second electric electrode 822*a* to be separated therefrom. Alternatively, only one second dummy electrode 822*b* may be provided around the second electric electrode 822*a*. Each of the second dummy electrodes 822*b* may have a variety of shapes such as a continuous line shape, a dotted line shape, or a dashed line shape. The second pad 862 may be formed in an integral type electric pad. The second pad 862 is provided to correspond to the second electric electrode 822*a* and the second dummy electrodes 822*b*. Accordingly, the second pad 862 may be bonded to the second electric electrode 822*a* and the second dummy electrodes 822*b*. The second pad 862 applies an electric signal to the conductive substrate 211 that is a lower electrode, via the second electric electrode 822*a*. The second pad 862 is bonded to the second dummy electrodes 822*b* and supports the conductive substrate 211 and the pad substrate 251. Meanwhile, a first electrode (not shown) that is connected to the upper electrode 215 may have the same shape as that of the second electrode 822. A first pad (not shown) that is bonded to the first electrode may have the same shape as that of the second pad 862.

Figure 17:
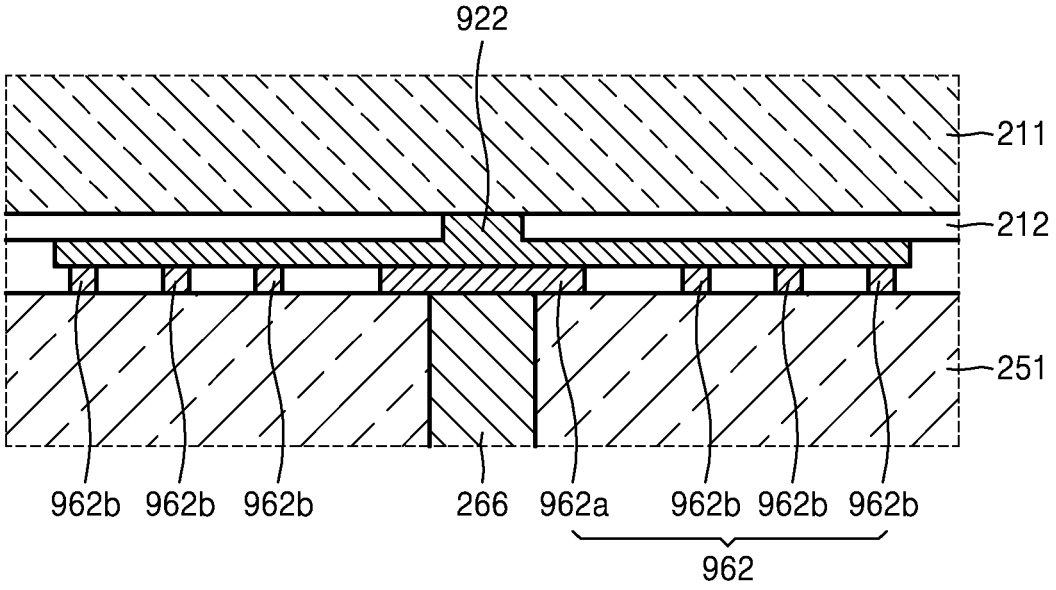
FIG. 17 is a cross-sectional view of a second electrode and a second pad according to another exemplary embodiment.

FIG. 17 is a cross-sectional view of a second electrode 922 and a second pad 962 according to another exemplary embodiment. Referring to FIG. 17, the second electrode 922 may be formed as an integral type electric electrode. The second pad 962 includes a second electric pad 962*a* for electric connection and a plurality of second dummy pads 962*b* that are provided around the second electric pad 962*a* to be separated therefrom. Alternatively, only one second dummy pad 962*b* may be provided around the second electric pad 962*a*. Each of the second dummy pads 962*b* may have a variety of shapes such as a continuous line shape, a dotted line shape, or a dashed line shape. The second electric pad 962*a* and the second dummy pads 962*b* are provided to correspond to the second electrode 922. Accordingly, the second electrode 922 may be bonded to the second electric pad 962*a* and the second dummy pads 962*b*. The second electrode 922 applies an electric signal to the conductive substrate 211 that is a lower electrode, via the second electric pad 962*a*. The second electrode 82 is bonded to the second dummy pads 962*b* and supports the conductive substrate 211 and the pad substrate 251. Meanwhile, a first electrode (not shown) that is connected to the upper electrode 215 may have the same shape as that of the second electrode 922. A first pad (not shown) that is bonded to the first electrode may have the same shape as that of second pad 962.

As described above, according to the electro-acoustic transducer according to the one or more of the above embodiments of the present invention, since the dummy patterns that support the conductive substrate and the pad substrate are provided around the electric pattern for electric connection, the unnecessary vibration that occurs due to the empty space formed between the conductive substrate and the pad substrate may be prevented. Accordingly, a frequency response characteristic in a wide frequency range may be improved. Also, since the bonding area may be reduced, a pressure applied for each unit area during bonding may be reduced. Furthermore, a short circuit that may occur between the adjoining electrodes may be prevented.

The foregoing exemplary embodiments and advantages are merely exemplary and are not to be construed as limiting. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An electro-acoustic transducer comprising:

a conductive substrate provided with a cell, a first electrode, and a second electrode; and a pad substrate disposed to correspond to the conductive substrate and provided with pads corresponding to the first electrode and the second electrode, wherein the first electrode, the second electrode, and the pads comprise a corresponding electric pattern for electrical connection and a corresponding dummy pattern that is provided around the corresponding electric pattern to be separated from the corresponding electric pattern, and the dummy pattern of the first electrode and the dummy pattern of the second electrode are disposed between the first electrode and the second electrode.

2. The electro-acoustic transducer of claim 1, wherein the electric pattern of each of the first electrode and the second electrode comprises an electric electrode for electrical connection; and the dummy pattern of each of the first electrode and the second electrode comprises a dummy electrode that is provided around a corresponding electric electrode to be separated from the corresponding electric electrode.

3. The electro-acoustic transducer of claim 2, wherein the electric pattern of the pads comprises an electric pad that is bonded to the first electric electrode or the second electrode, and the dummy pattern of the pads comprises a dummy pad that is bonded to the dummy electrode of the first electrode or the second electrode and is provided around a corresponding electric pad to be separated from the corresponding electric pad.

4. The electro-acoustic transducer of claim 1, wherein the dummy pattern of the first and second electrodes comprises a plurality of dummy electrodes and the dummy pattern of the pads comprises a plurality of dummy pads, and each of the plurality of dummy electrodes is provided to have a one-to-one correspondence with each of the plurality of dummy pads.

5. The electro-acoustic transducer of claim 3, wherein one dummy electrode corresponds to a plurality of dummy pads or a plurality of dummy electrodes correspond to one dummy pad.

6. The electro-acoustic transducer of claim 2, wherein the pads are formed as integral type electric pads which are respectively bonded to the electric electrode and the dummy electrode of the first and second electrodes.

7. The electro-acoustic transducer of claim 1, wherein the electric pattern of the pads comprises an electric pad for electrical connection and the dummy pattern of the pads comprises a dummy pad that is provided around a corresponding electric pad to be separated from the corresponding electric pad, and at least one among the first electrode and the second electrode is formed as an integral type electric electrode and is bonded to the electric pad and the dummy pad of a respective pad.

8. The electro-acoustic transducer of claim 1, wherein the dummy pattern is provided to completely surround the corresponding electric pattern.

9. The electro-acoustic transducer of claim 1, wherein the dummy pattern of at least one among the first electrode and the second electrode has a continuous line shape.

10. The electro-acoustic transducer of claim 1, wherein the dummy pattern of at least one among the first electrode and the second electrode has at least one of a discontinuous dotted line shape and a discontinuous dashed line shape.

11. The electro-acoustic transducer of claim 1, wherein each of the first electrode and the second electrode are bonded to a respective pad by eutectic bonding.

12. The electro-acoustic transducer of claim 1, wherein at least one among the first electrode and the second electrode comprises tin (Sn) and at least one of gold (Au), copper (Cu), and silver (Ag), and a respective pad comprises at least one of Au, Cu, and Ag, or the respective pad comprises Sn and at least one of Au, Cu, and Ag, and the at least one of the first electrode and the second electrode comprises at least one of Au, Cu, and Ag.

13. The electro-acoustic transducer of claim 1, wherein an area of the electric pattern of least one among the first electrode, the second electrode, and one of the pads is from about 2500 $\mu m^2$ to about 40000 $\mu m^2$, and a width of the dummy pattern of the at least one among the first electrode, the second electrode, and one of the pads is from about 3 μm to about 50 μm.

14. The electro-acoustic transducer of claim 1, wherein a distance between the electric pattern and the corresponding dummy pattern is from about 3 μm to about 50 μm, and, when a number of dummy patterns is provided around the corresponding electric pattern, a distance between at least two adjacent dummy patterns is from about 3 μm to about 50 μm.

15. The electro-acoustic transducer of claim 1, wherein the dummy pattern of the first electrode and the dummy pattern of the second electrode are disposed between the first electrode and the second electrode in a space between a lower surface of the conductive substrate and an upper surface of the pad substrate.

16. An electro-acoustic transducer comprising:

a conductive substrate provided with a first electrode and a second electrode on one surface of the conductive substrate; and a pad substrate disposed to correspond to the conductive substrate and provided with pads corresponding to the first and second electrodes, wherein each of the first electrode and the second electrode comprises an electric electrode for electrical connection and a dummy electrode that is provided around a corresponding electric electrode to be separated from the corresponding electric electrode, and the dummy pattern of the first electrode and the dummy pattern of the second electrode are disposed between the first electrode and the second electrode.

17. The electro-acoustic transducer of claim 16, wherein at least one of the pads comprises:

an electric pad that is bonded to the electric electrode of at least one of the first electrode and the second electrode; and a dummy pad that is bonded to the dummy electrode of the at least one of the first electrode and the second electrode and is provided around the electric pad to be separated the electric pad.

18. The electro-acoustic transducer of claim 16, wherein the dummy electrode of each of the first electrode and the second electrode is provided to surround a corresponding electric electrode, and comprises at least one of a continuous line shape, a discontinuous dotted line shape, and a discontinuous dashed line shape.

19. The electro-acoustic transducer of claim 16, wherein at least one among the first electrode and the second electrode comprises tin (Sn) and at least one of gold (Au), copper (Cu), and silver (Ag), and a respective pad comprises at least one of Au, Cu, and Ag, or the respective pad comprises Sn and at least one of Au, Cu, and Ag, and the at least one among the first electrode and the second electrode comprises at least one of Au, Cu, and Ag.

20. The electro-acoustic transducer of claim 16, wherein an area of the electric electrode of least one among the first electrode, the second electrode, and one of the pads is from about 2500 $\mu m^2$ to about 40000 μm', and a width of the dummy electrode of the least one among the first electrode, the second electrode, and one of the pads is from about 3 μm to about 50 μm.

21. The electro-acoustic transducer of claim 16, wherein an interval between the electric electrode of least one among the first electrode, the second electrode, and one of the pads and a corresponding dummy electrode is from about 3 μm to about 50 μm.

22. An electro-acoustic transducer comprising:

a conductive substrate provided with a cell, a first electrode, and a second electrode;

a pad substrate disposed to correspond to the conductive substrate and provided with pads corresponding to the first electrode and the second electrode;

a support provided on the conductive substrate and forming the cell;

a membrane provided on the support to cover the cell; and an upper electrode provided on the membrane, wherein each of the first electrode, the second electrode, and the pads comprises a corresponding electric pattern for electrical connection and a corresponding dummy pattern that is provided around the corresponding electric pattern to be separated from the corresponding electric pattern, and the dummy pattern of the first electrode and the dummy pattern of the second electrode are disposed between the first electrode and the second electrode.

* * * * *